US009238248B2

(12) United States Patent
Hochholzer et al.

(10) Patent No.: US 9,238,248 B2
(45) Date of Patent: Jan. 19, 2016

(54) PAINTING AID FOR A VEHICLE DOOR HANDLE

(75) Inventors: Georg Hochholzer, Beilngries (DE); Andre Schubert, Oelsnitz (DE)

(73) Assignee: AUDI AG, Ingolstadt (DE)

( * ) Notice: Subject to any disclaimer, the term of this patent is extended or adjusted under 35 U.S.C. 154(b) by 77 days.

(21) Appl. No.: 13/879,552

(22) PCT Filed: Sep. 1, 2011

(86) PCT No.: PCT/EP2011/004413

§ 371 (c)(1),
(2), (4) Date: Jul. 15, 2013

(87) PCT Pub. No.: WO2012/048773

PCT Pub. Date: Apr. 19, 2012

(65) Prior Publication Data

US 2014/0150720 A1 Jun. 5, 2014

(30) Foreign Application Priority Data

Oct. 16, 2010 (DE) ..... 10 2010 048 744

(51) Int. Cl.
*B05C 21/00* (2006.01)
*B05B 15/04* (2006.01)
(Continued)

(52) U.S. Cl.
CPC ..... *B05C 21/005* (2013.01); *B05B 15/045* (2013.01); *E05B 85/16* (2013.01); *E05C 21/005* (2013.01)

(58) Field of Classification Search
CPC ..... B05C 21/005; B05B 15/045
USPC ..... 118/504, 505, 500, 503, 303, 721; 427/282, 401; 174/66; 292/336.3
See application file for complete search history.

(56) References Cited

U.S. PATENT DOCUMENTS 4,656,058 A * 4/1987 Stark ..... B05D 1/32 118/504
6,165,269 A 12/2000 Kathe
7,022,915 B1 * 4/2006 Galguera ..... 174/66
(Continued)

FOREIGN PATENT DOCUMENTS

CN 1605698 A 4/2005
CN 1625444 A 6/2005
(Continued)

OTHER PUBLICATIONS

International Search Report issued by the European Patent Office in International Application PCT/EP2011/004413 on Nov. 18, 2011.
(Continued)

*Primary Examiner* — Yewebdar Tadesse
(74) *Attorney, Agent, or Firm* — Henry M. Feiereisen LLC

(57) ABSTRACT

Painting aid 1 for a door handle 2 of a vehicle, having a door handle 2 with a door handle body 3 to be arranged outside of a vehicle door, wherein the door handle body 3 has a support projection 4 for pivotally supporting the door handle body 3 on the vehicle door and an actuating projection 5 for actuating a door lock, and having a cap 6*a* or 6*b* to be arranged next to the door handle body 3 on the vehicle door at a fixed position. The painting aid 1 has a cover section 7 enclosing the actuating projection 5 in order to prevent paint from being applied on the actuating projection 5. The painting aid 1 also has a retaining section 8 arranged next to the cover section 7 for retaining the cap 6*a* or 6*b*.

8 Claims, 3 Drawing Sheets

(51) Int. Cl.
*E05B 85/16* (2014.01)
*E05C 21/00* (2006.01)

(56) References Cited

U.S. PATENT DOCUMENTS

| | | | | |
|---|---|---|---|---|
| 7,077,909 | B1 | 7/2006 | Crane | |
| 2003/0213097 | A1 | 11/2003 | Bowers | |
| 2005/0073804 | A1 * | 4/2005 | Maruyama | B44C 5/00 361/600 |
| 2007/0182166 | A1 | 8/2007 | Schindler et al. | |

FOREIGN PATENT DOCUMENTS

| | | |
|---|---|---|
| DE | 102 36 834 | 2/2004 |
| DE | 103 48 719 | 5/2005 |
| DE | 103 57 935 | 7/2005 |
| EP | 1 508 381 | 2/2005 |
| JP | 2001-121048 | 5/2001 |
| KR | 10-2006-0098388 | 9/2006 |

OTHER PUBLICATIONS

Chinese Search Report issued by the Chinese Patent Office in Chinese Application No. 2011800499368 on Feb. 4, 2015.

English translation of Chinese Search Report issued by the Chinese Patent Office in Chinese Application No. 2011800499368 on Feb. 4, 2015.

* cited by examiner

PAINTING AID FOR A VEHICLE DOOR HANDLE

CROSS-REFERENCES TO RELATED APPLICATIONS

This application is the U.S. National Stage of International Application No. PCT/EP2011/004413, filed Sep. 1, 2011, which designated the United States and has been published as International Publication No. WO 2012/048773 and which claims the priority of German Patent Application, Serial No. 10 2010 048 744.9, filed Oct. 16, 2010, pursuant to 35 U.S.C. 119(a)-(d).

BACKGROUND OF THE INVENTION

The invention relates to a painting aid for a door handle of a vehicle, in particular for a door handle with an actuating projection for actuating a door lock, with a bearing projection for pivotally connecting the door handle on a vehicle door, and with a cover arranged next to the door handle at a fixed location with or without a locking cylinder.

Painting aids of this type are used in vehicle assembly while the door handles are painted so as to prevent paint to be applied at undesirable locations, for example on the actuating projection.

A door handle for a vehicle door, as illustrated for example in DE 103 48 719 A1, has a door handle body arranged on the outer side of the door and configured to be grasped by a person, as well as a bearing projection and an actuating projection which protrude from the door handle body and engage in the door. The bearing projection supports the door handle body pivotally on the door, and the actuating projection actuates a door lock disposed inside the vehicle door when the door handle body is pivoted. A separate cap is arranged at a fixed location, in addition to the pivotable door handle body. The cap can be formed as a blind cap or can include a locking cylinder for locking and unlocking the door lock. The door handle body and the cap are preferably painted separately from the vehicle (off-line painting). To enable a clean operation of the door lock, the actuator must be kept free from paint; this can be ensured by using painting aids in the form of sleeves or spouts arranged on the actuating projection.

One problem is that the cap and door handle body should be painted together to achieve good color fidelity. However, since separate components must be handled during off-line painting, logistical and handling problems result when the separate components are painted together in the same painting facility. There is also the risk that the correct association to each other is lost in the further manufacturing process.

SUMMARY OF THE INVENTION

It is therefore an object of the present invention to provide a painting aid for a door handle of a vehicle, which allows a common off-line painting of the door handle body and the cap in a simple manner.

According to an aspect of the invention, a painting aid for a door handle of a vehicle includes a door handle with a door handle body to be arranged outside of a vehicle door, wherein the door handle has a bearing projection for pivotally supporting the door handle body on the vehicle door and an actuating projection for actuating a door lock, and a cap to be arranged at a fixed location on the vehicle door next to the door handle body, wherein the painting aid has a cover section enclosing the actuating extension for preventing paint to be applied to the actuating attachment, and wherein the painting aid has in addition to the cover section a retaining section for retaining the cover.

Because the painting aid has, for protecting the actuating attachment from paint application, in addition to the cover section a retaining section for temporarily receiving the cover, the door handle body and cap can be painted together off-line in a simple manner. The painting process thus becomes much easier, since the cap is in fixed association with the door handle body and the two components can be handled together. For example, a separate device for suspending the cap can be omitted by suspending the door handle body for painting on the bearing projection. The painting aid can be reused several times. The door handle and cap together form the door handle. The door handle body is used to allow handling by a person and can be pivoted about a pivot axis formed by the bearing projection. Conversely, the cap is arranged on the vehicle door in a fixed position next to the door handle body.

In a preferred embodiment, the retaining section is integrally formed on the cover section. The painting aid can be produced in a particularly simple manner as a plastic injection molded part by integrally forming the retaining section on the cover section.

In a preferred embodiment, the retaining section has detent means for receiving the cap. The cap can be easily and quickly attached to the painting aid with the detent means and removed again after painting is complete.

In a preferred embodiment, the detent means are formed as so as to catch from behind. These detent means catching from behind engage in complementary recesses of the cap, thus ensuring a secure attachment.

In a preferred embodiment, the detent means are configured to retain different types of caps. A painting aid can thus be used universally for a plurality of caps. Caps can receive, for example, a locking cylinder or can be constructed as a blank cap.

In a preferred embodiment, the cover section is constructed to be opened and snapped shut. A cover section that can be opened and shut in this manner facilitates insertion even when the actuating projection has a complex-shape.

In a preferred embodiment, the cover section is formed as a U-shaped profile that matches the actuating projection and can be closed by a pivotable lid. The profile forms a rail, which is adapted in its shape and size to the actuating projection. The profile is closed off by the lid and the actuating projection is fixed therein.

In a preferred embodiment, the lid is pivotally connected to the profile by a film hinge. A film hinge can be particularly easily molded, which lowers the manufacturing costs of the painting aid.

In a preferred embodiment, the lid can interlock with the profile. For this purpose, the lid has openings which may engage with detent means disposed on the profile.

In a preferred embodiment, a mandrel for engagement with the handle body is disposed on the painting aid. The mandrel engages in the interior of the door handle body and thus fixes a wall of the door handle body between the mandrel and the cover section. In this way, the painting aid can be securely attached to the door handle body.

BRIEF DESCRIPTION OF THE DRAWING

Further details, features and advantages of the invention will become apparent from the following description of a preferred exemplary embodiment with reference to the drawings.

The drawings show in.

DETAILED DESCRIPTION OF PREFERRED EMBODIMENTS

Figure 1:
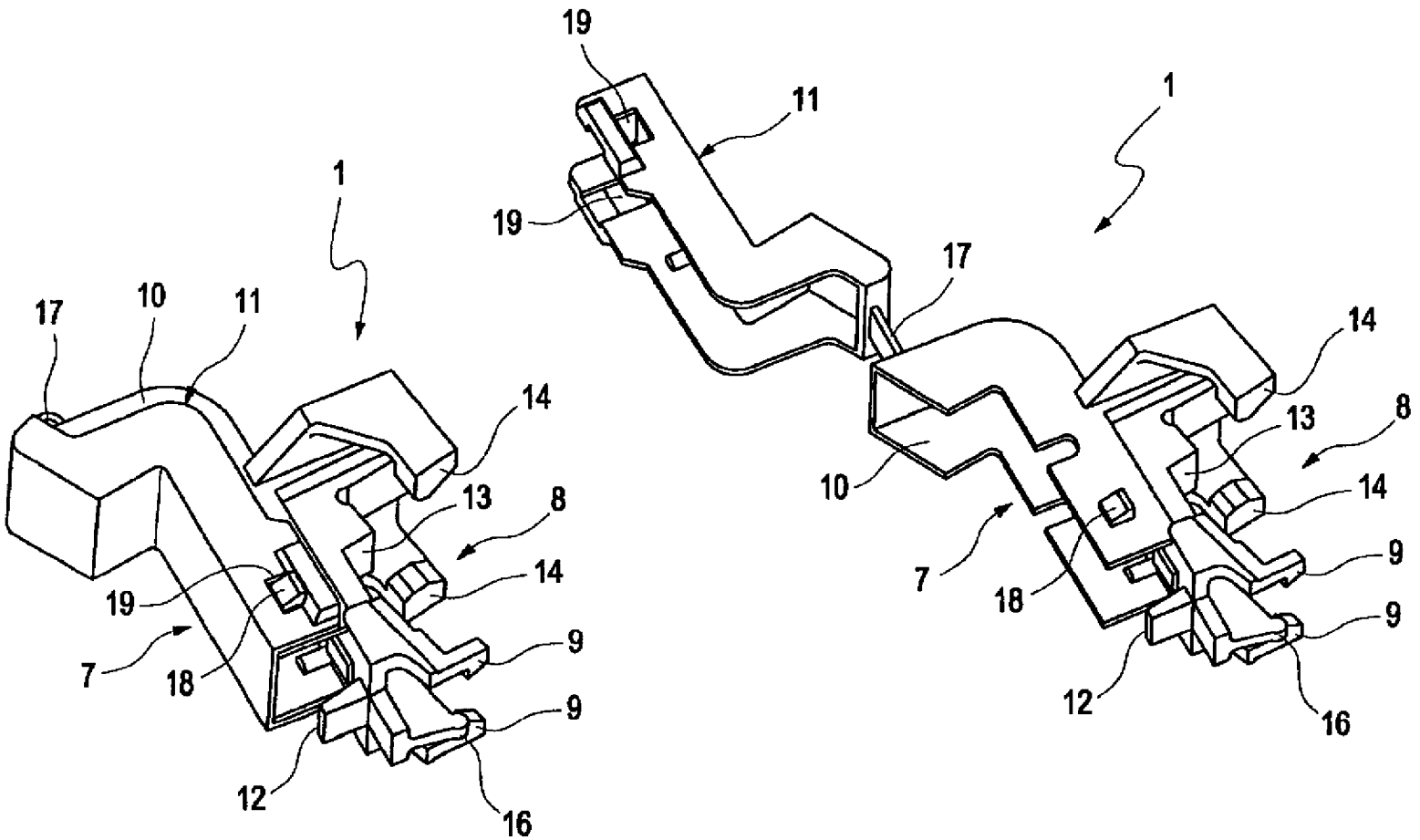
FIG. 1 a painting aid with an open and closed lid.

FIG. 1 shows a painting aid 1 with a closed and an open lid 11 of the cover section 7. The painting aid 1 is composed of two sections, a cover section 7 and a retaining section 8. The cover section 7 is configured to enclose an actuating projection 5 of a door handle body 3, as illustrated in FIG. 4, and to thereby protect the actuating projection 5 from paint application during the painting process. For this purpose, the cover section 7 has a U-shaped profile 10, whose shape matches the shape of the actuating projection 5. For easier insertion of the actuating projection 5, a pivotable lid 11 is attached to the profile 10 by a film hinge 17. The lid 11 has openings 19 constructed to latch with complementary detent means 18 disposed on the profile 10 for closing the lid 11. A mandrel 12 may engage in the door handle body 3 and serves to stabilize the painting aid 1 on the door handle body 3. The retaining section 8 integrally formed on the cover section 7 serves to temporarily receive a cap 6*a* or 6*b* illustrated in FIGS. 2-4. For this purpose, detent means 9 formed to engage from behind are provided. The cap 6*a* or 6*b* can be stabilized by guides 14, a first limit stop 13, and a second limit stop 16.

Figure 2:
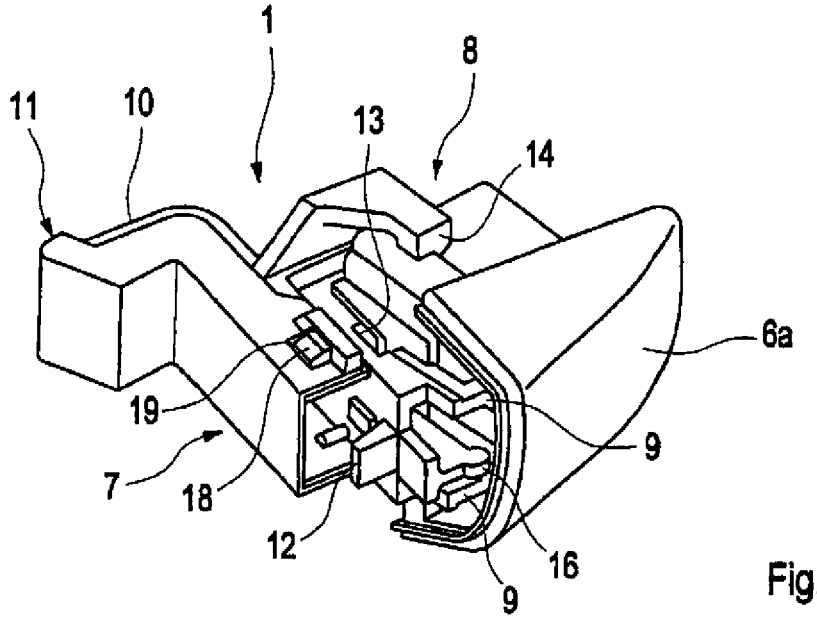
FIG. 2 a painting aid with a cap.

FIG. 2 shows the painting aid 1 previously illustrated in FIG. 1 with a cap 6*a*. The cap 6*a* is formed as a blank cover, wherein the detent means 9 engage in the cap 6*a*. The guides 14, the first limit stop 13 and the second limit stop 16 contact the cap 6*a* and stabilize the cap 6*a*.

Figure 3:
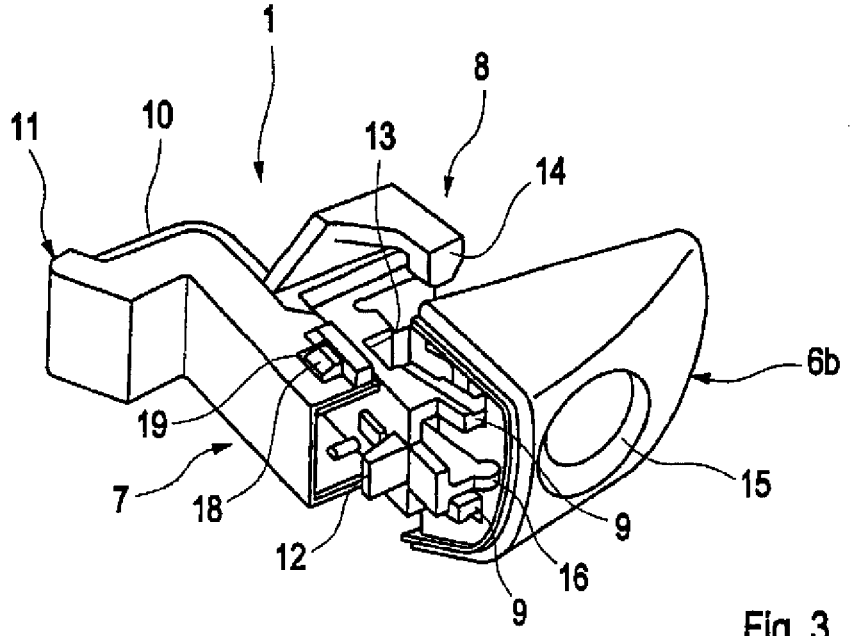
FIG. 3 a painting aid with another cap.
Figure 4:
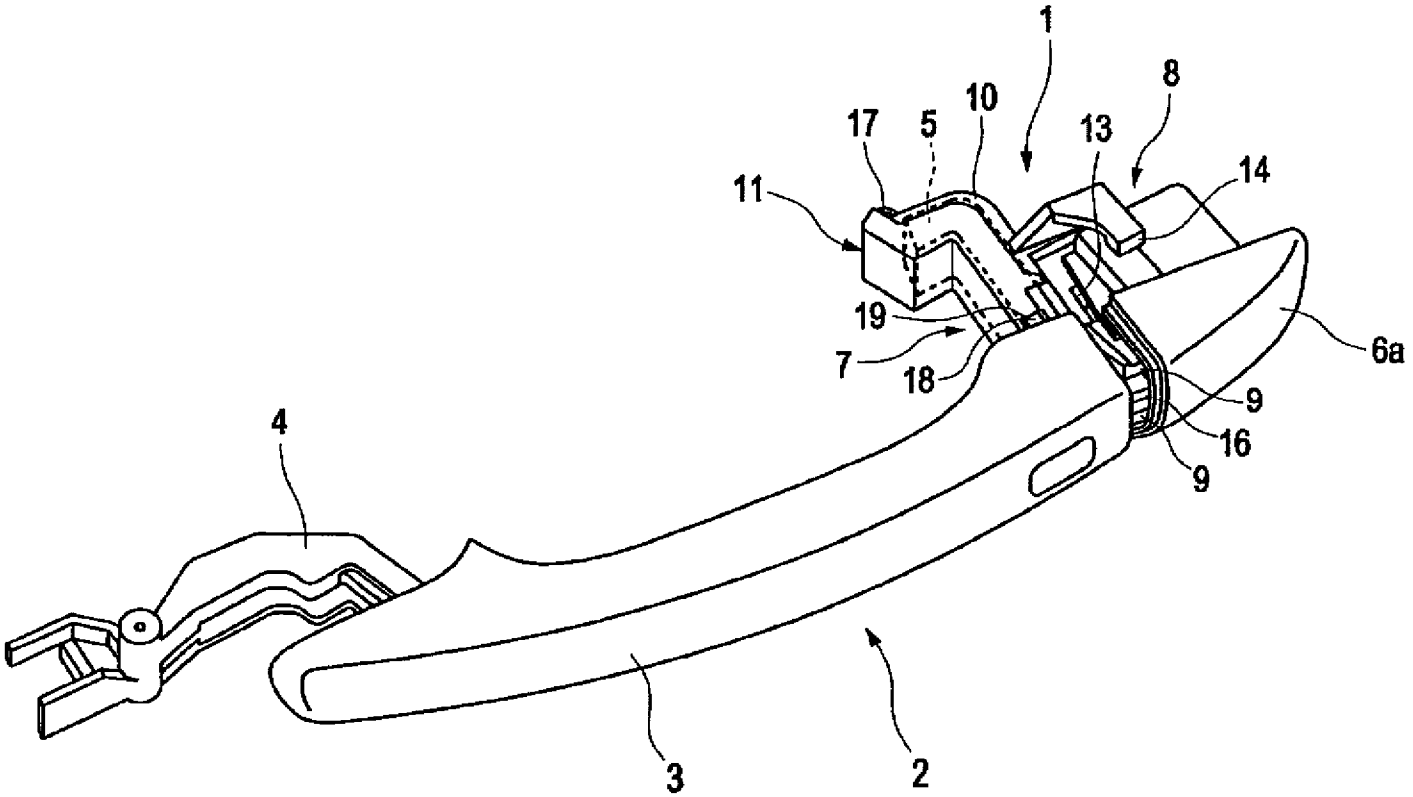
FIG. 4 a painting aid with a door handle body and cap arranged thereon.

FIG. 3 shows the painting aid 1 previously illustrated in FIG. 1 with an alternate cap 6*b*. The cap 6*b* is built shorter than the cap 6*a* and has an opening 15 for receiving an unillustrated locking cylinder for a door lock. The cap 6*b* is also held by the detent means 9, but contacts only the second limit stop 16.

FIG. 4 shows the painting aid 1 previously illustrated in FIG. 1 with a cap 6*a* and a door handle body 3. The cap 6*a* and the door handle body 3 form together, after installation in an unillustrated vehicle door, a door handle 2. The door handle body 3 may be arranged of the vehicle door so as to provide access from the outside. A bearing projection 4 and an actuating projection 5 protrude from the door handle body 3, which after installation engage in the vehicle door. The bearing projection 4 is used to support the door handle body 3 on the vehicle door and forms a pivot axis for the door handle body 3. The actuating projection 5 is used to actuate an unillustrated door lock. By inserting the actuation projection 5 into a profile 10 that can be closed off by a lid 11, the actuating projection 5 is enclosed by the cover section 7 of the painting aid 1 during the painting process. The profile 10 has for this purpose detent means 18 with which the lid 11 can latch. The cover section 7 is followed by a retaining section 8 which in the present embodiment carries a cap 6*a*. The cap 6*a* hereby latches with detent means 9. The cap 6*a* also contacts the guides 14, the first limit stop 13 and the second limit stop 16 for stabilization. The door handle 2 held in this fashion by the painting aid 1 can be particularly easily handled in an off-line painting process, wherein the door handle body 3 and the cap 6*a* receive an identical paint application, while the actuating projection 5 is protected from paint application.

The invention claimed is:

1. A painting aid in combination with a door handle of a vehicle, wherein the door handle includes a door handle body arranged outside a vehicle door and a bearing projection for pivotally mounting the door handle body on the vehicle door, and an actuation projection for actuating a door lock, as well as a cap arranged at a fixed position next to the door handle body on the vehicle door, the painting aid comprising:

a cover section surrounding the actuation projection for preventing paint to be applied to the actuating projection, and a retaining section comprising a detent configured to interlock with a complementary structure disposed on the cap for retaining the painting aid on the door handle.

2. The painting aid of claim 1, wherein the retaining section is integrally formed on the cover section.

3. The painting aid of claim 1, wherein the detent is configured to interlock with different types of caps.

4. The painting aid of claim 1, wherein the cover section is constructed to be opened and snapped shut.

5. The painting aid of claim 1, wherein the cover section is constructed as a U-shaped profile matching the actuation projection, the painting aid further comprising a pivoting lid configured to close off the U-shaped profile.

6. The painting aid of claim 5, further comprising a film hinge which pivotally connects the pivoting lid to the U-shaped profile.

7. The painting aid of claim 5, wherein the pivoting lid is configured to interlock with the U-shaped profile.

8. The painting aid of claim 1, further comprising a mandrel arranged on the painting aid and configured to engage in the door handle body.

* * * * *